US006159042A

United States Patent [19]

Liu et al.

[11] Patent Number: 6,159,042

[45] **Date of Patent: *Dec. 12, 2000**

[54] ELECTRICAL CONNECTOR

[75] Inventors: Jia-Hung Liu, Hsin-Chuang; Jerry Wu, Chang-Hus Hsien, both of Taiwan

[73] Assignee: Hon Hai Precision Ind. Co., Ltd., Taipei Hsien, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 09/104,893

[22] Filed: Jun. 25, 1998

[30] Foreign Application Priority Data

Dec. 31, 1997 [TW] Taiwan ..... 86221850

[51] Int. Cl.[7] ..... H01R 13/60

[52] U.S. Cl. ..... 439/567; 439/571; 439/79

[58] Field of Search ..... 439/567, 571

[56] References Cited

U.S. PATENT DOCUMENTS 5,704,808 1/1998 Chishima ..... 439/571

5,827,089 10/1998 Beck, Jr. ..... 439/567

5,921,789 7/1999 Makino et al. ..... 439/79

*Primary Examiner*—Paula Bradley

*Assistant Examiner*—Katrina Davis

[57] ABSTRACT

A battery connector for connecting a battery to supply electrical power to an electrical apparatus incorporating the connector comprises a housing and a number of contacts fixedly mounted in the housing. Each contact has a substantially identical structure. The contacts are mounted in grooves defined in the housing having different depths, whereby tail portions of the contacts are spaced different distances from a front face of the housing for proximity to the battery. Thus, when the connector is mounted to a printed circuit board by extending the tail portions of the contacts into holes defined in the printed circuit board, the tail portions of the contacts which are located closer to the front face of the housing fixedly engage with front edges of the corresponding holes and the tail portions of the other contacts fixedly engage with rear edges of the other holes.

18 Claims, 6 Drawing Sheets

ELECTRICAL CONNECTOR

BACKGROUND OF THE INVENTION

1. Field of the Invention

The present invention relates to an electrical connector, and particularly to an electrical connector for electrically connecting a battery to a printed circuit board (PCB) in a portable electrical device.

2. The Prior Art

Battery connectors are mainly used in portable electrical devices, for example cellular phones or lap-top computers, to connect with batteries to supply the electrical devices with electrical power. Prior art relating to battery connectors is disclosed in U.S. Pat. Nos. 4,632,475, 4,975,062 and 5,551,883 and Taiwan Patent Application Nos. 83107591 and 84210634.

To mount a battery connector to a printed circuit board in an electrical device, board locks are firstly provided to the connector. The board locks are extended through holes defined in the PCB to interferentially engage therewith. The board locks increase the cost of the connectors, and forming board lock mounting holes in the PCB reduces the area available on the PCB for accommodating electronic components.

To overcome the disadvantages of the prior art, an improvement has been proposed as shown in FIGS. 6 and 7. In FIG. 6, a battery connector 4 has three first contacts 52 and three second contact 54 alternating with each other. Each first contact 52 has a contact portion 522 for engaging with a corresponding contact in a mating connector for electrically connecting with a battery (not shown), and a tail portion 524 substantially perpendicular to the contact portion 522 for connecting with a PCB 3 (FIG. 7). The tail portion 524 has an engaging portion 526 projecting forward therefrom. Each second contact 54 has a contact portion 542 substantially the same as that of the first contact 52, a tail portion 544 perpendicular to the contact portion 542 and an engaging portion 546 projecting rearward from the tail portion 544. A housing 40 defines a number of grooves 41 in a rear face thereof. Each groove 41 has the same depth. A locating wall 43 extends forward from a front face of the housing 40 in alignment with the second groove counting from the left side of the housing 40. The locating wall 43 ensures the correct orientation of the connector 4 with a mating connector for electrically connecting with the battery. Each groove 41 communicates with a slot 42 defined through the connector 4, except for the groove 41 aligned with the locating wall 43.

After fixedly mounting the contacts 52, 54 in the corresponding grooves 41 of the housing 40, the contact portions 522, 542 extend through the corresponding slots 42 to project beyond the front face of the housing 40 and the engaging portions 526, 546 of the contacts 52, 54 project in opposite directions. When the connector 4 is mounted to the PCB 3 by extending the tail portions 524, 544 into corresponding holes 31 in the PCB 3, the engaging portions 526, 546 of the contacts 52, 54 fixedly engage with front and rear edges of the corresponding holes 31, respectively, due to a resilience of the tail portions 524, 544. Therefore, the connector 4 is fixedly mounted to the PCB 3 without the necessity of board locks.

Although the prior art as shown in FIGS. 6 and 7 is proven to be advantageous over the prior art requiring the use of board locks, two different contact types are required, which still results in an increased cost of the connector.

Furthermore, inventory management of two contact types is troublesome and assembling a connector with two contact types is time consuming.

Hence, an improved battery connector is needed to eliminate the above mentioned defects of current battery connectors.

SUMMARY OF THE INVENTION

Accordingly, an objective of the present invention is to provide a battery connector which can be fixedly mounted to a PCB without the necessity of board locks and which requires only one contact type.

To fulfill the above mentioned objective, according to one embodiment of the present invention, a battery connector consists of a rectangular housing defining a front face for proximity to a battery, a bottom face for proximity to a printed circuit board, and a number of grooves in a rear face of the housing wherein the two outer-most grooves have a depth which is less than that of the inner grooves therebetween. A slot communicates between each groove and the front face of the housing. A number of substantially identical contacts are fixedly mounted in the grooves of the housing at a position wherein tail portions thereof extend beyond the bottom face of the housing. The tail portions of the contacts in the two outer-most grooves are spaced from the front face of the housing a distance less than that of the inner contacts. Therefore, when the connector is mounted to a printed circuit board by extending the tail portions into corresponding holes in the printed circuit board, the tail portions of the contacts in the outer-most grooves fixedly engage with front edges of the corresponding holes and the tail portions of the inner contacts fixedly engage with rear edges of the corresponding holes due to a resilience of the tail portions whereby the connector is fixedly connected to the printed circuit board.

DETAILED DESCRIPTION OF THE PREFERRED EMBODIMENT

Reference will now be made in detail to the preferred embodiment of the present invention.

Figure 1:
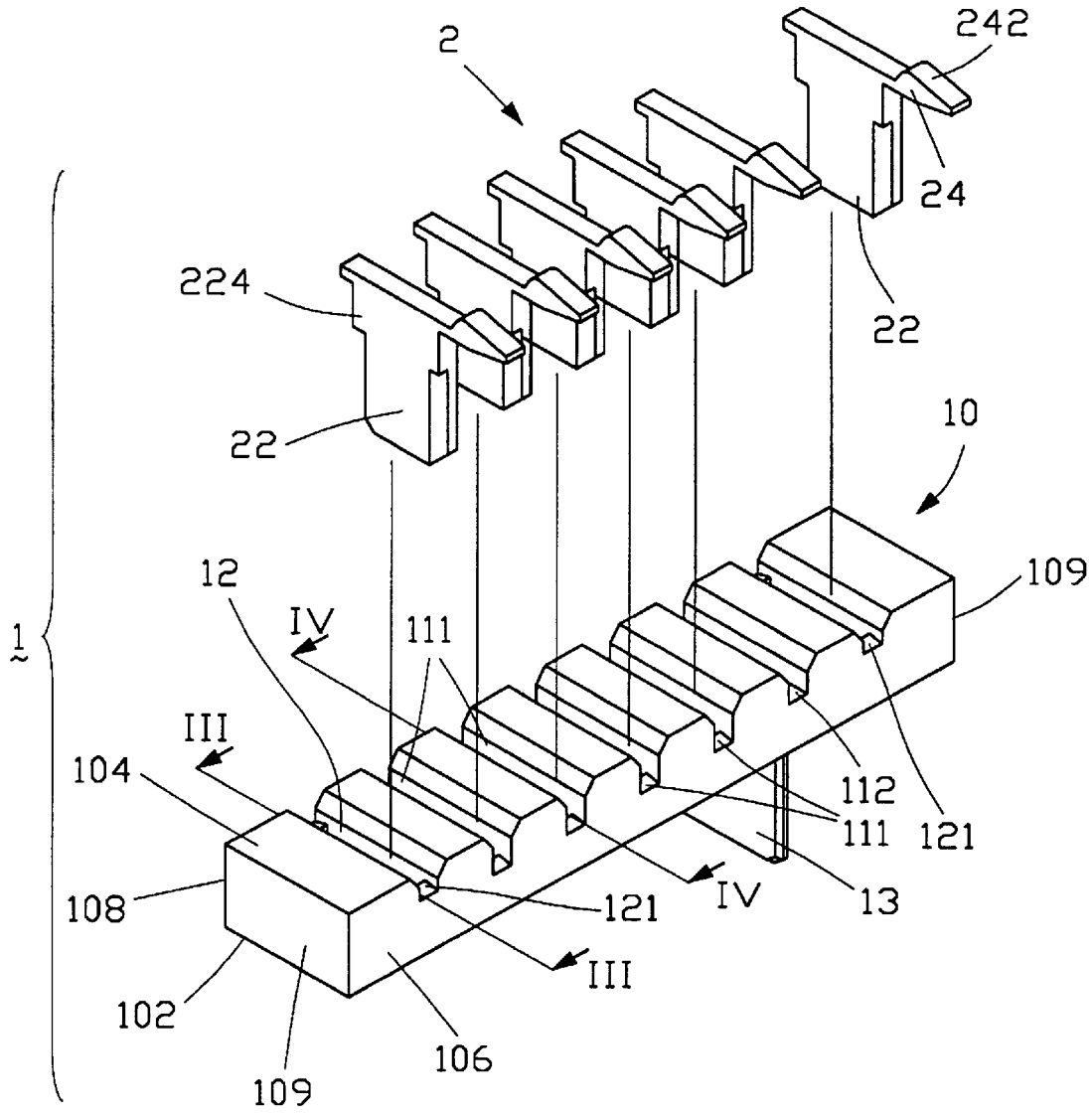
FIG. 1 is an exploded view of a battery connector in accordance with the present invention from a bottom, rear, right side perspective.
Figure 2:
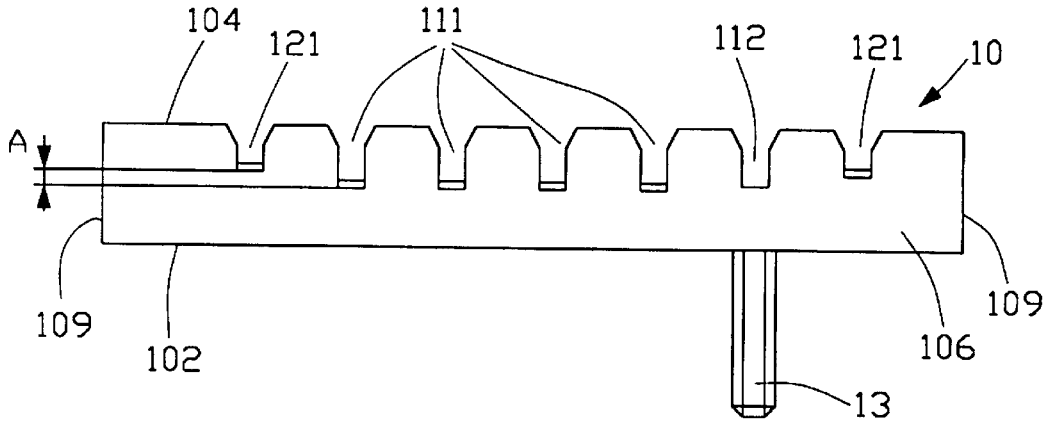
FIG. 2 is a bottom view of a housing of the battery connector of FIG. 1.

Referring to FIGS. 1 and 2, a battery connector 1 in accordance with the present invention includes a housing 10 defining a front face 102 for proximity to a battery (not shown), a rear face 104 opposite the front face 102, a bottom face 106 for proximity to a printed circuit board 30 (FIG. 5), a top face 108 opposite the bottom face 106, and two side faces 109 between the front, rear, bottom and top faces 102,

104, 106, 108, respectively. Six grooves each having a slot 12 communicating between the corresponding groove and the front face 102 of the housing 10 are defined in the rear face 104 from the top face 108 to the bottom face 106. The grooves include two outer-most grooves 121 located near the two side faces 109, respectively, and four inner grooves 111 between the outer-most grooves 121. The outer-most grooves 121 have a depth which is less than that of the inner grooves 111 by a distance of "A". A locating wall 13 extends forward from the front face 102 of the housing 10 at a location in alignment with a groove 112 between the inner grooves 111 and the outer-most groove 121 on the left side of the housing 10. Six substantially identical contacts 2 each have a contact portion 22 and a tail portion 24 perpendicular to the contact portion 22. Each contact portion 22 has a fitting step 224 at a rear, upper portion thereof for interferentially engaging with the housing 10 when the contacts 2 are mounted in the housing 10. Each tail portion 24 defines an engaging portion 242 projecting rearwards therefrom.

Figure 3:
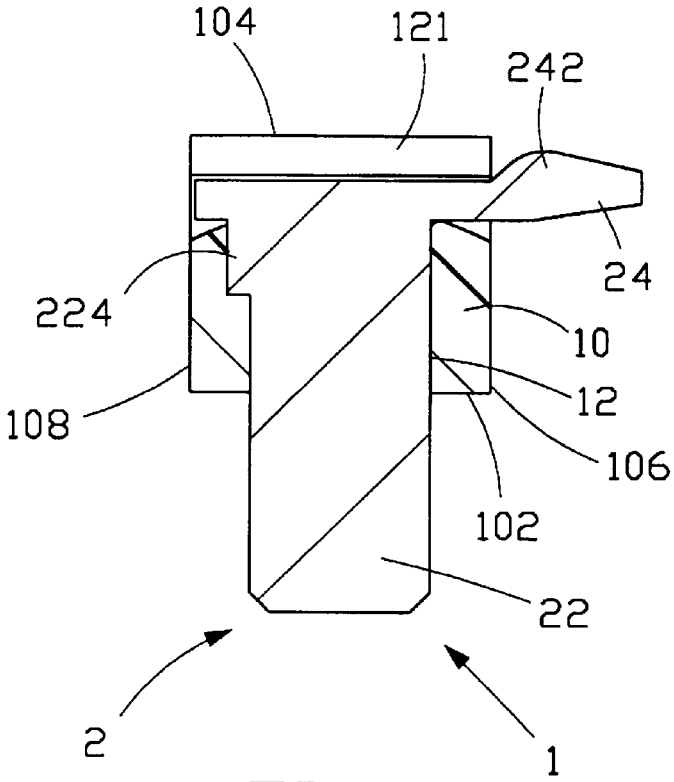
FIG. 3 is a cross-sectional view taken along line III—III of FIG. 1.
Figure 4:
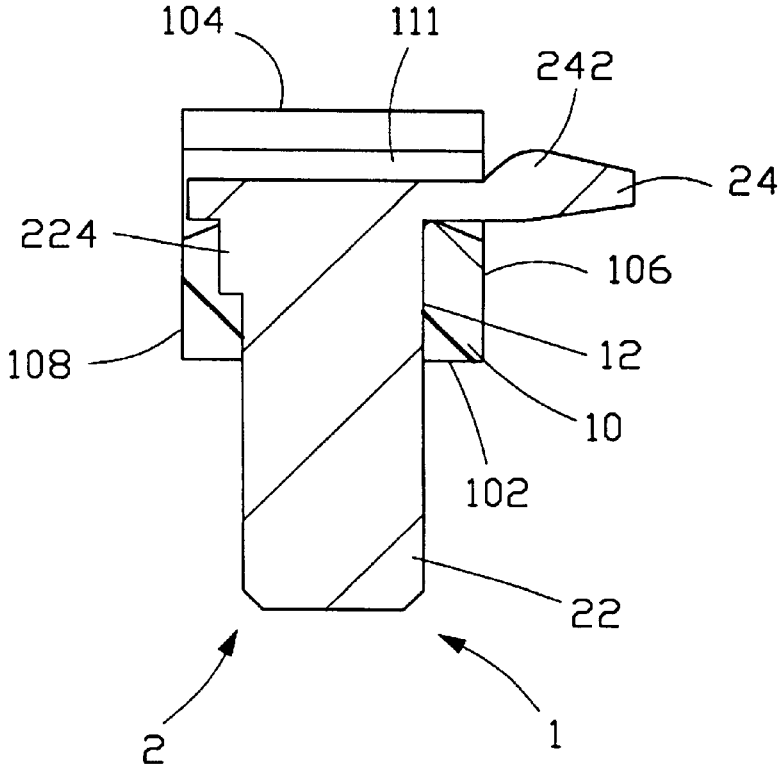
FIG. 4 is a cross-sectional view taken along line IV—IV of FIG. 1.
Figure 5:
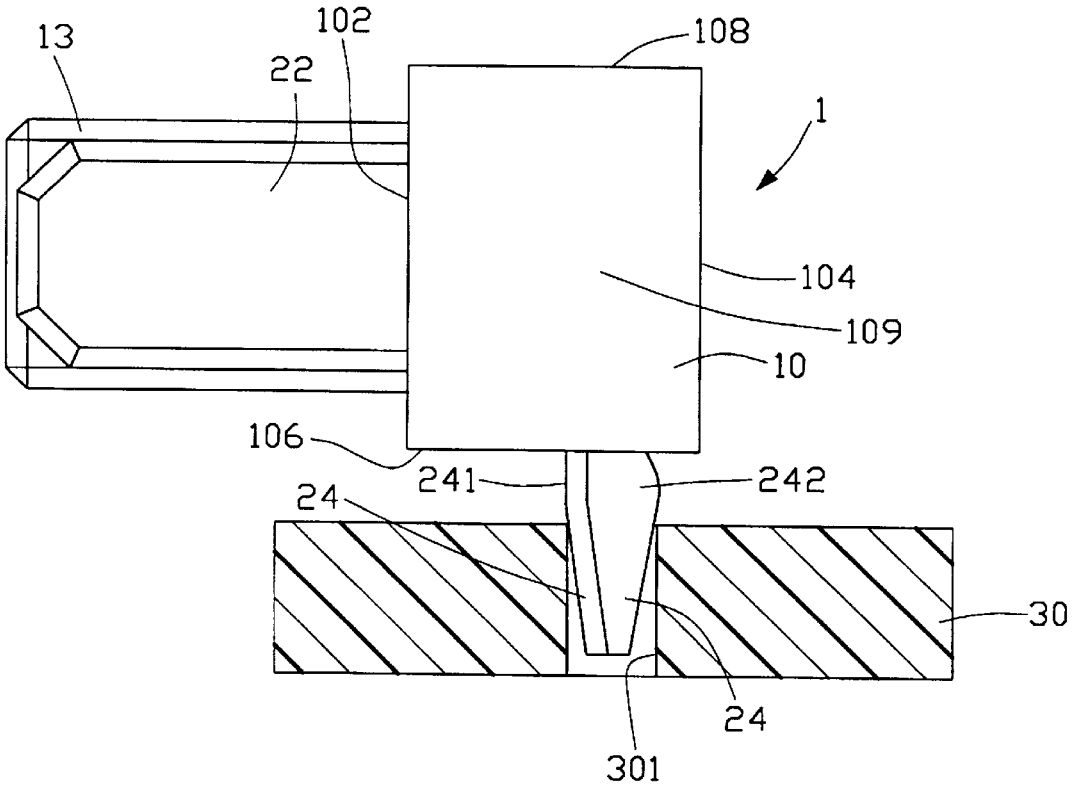
FIG. 5 is a cross-sectional view showing the connector of FIG. 1 mounted to a PCB.
Figure 6:
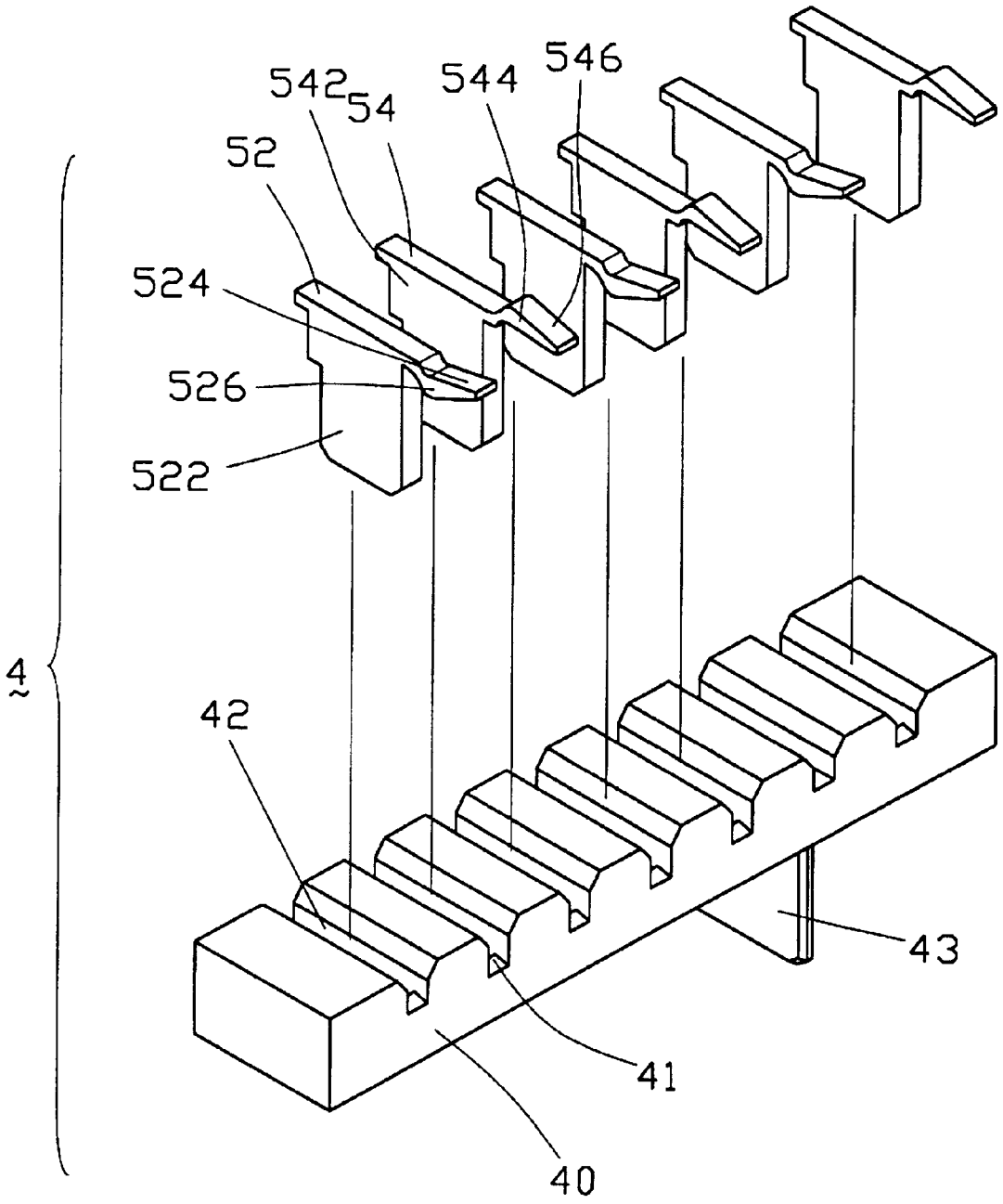
FIG. 6 (PRIOR ART)
FIG. 6 is an exploded view of a conventional battery connector.
Figure 7:
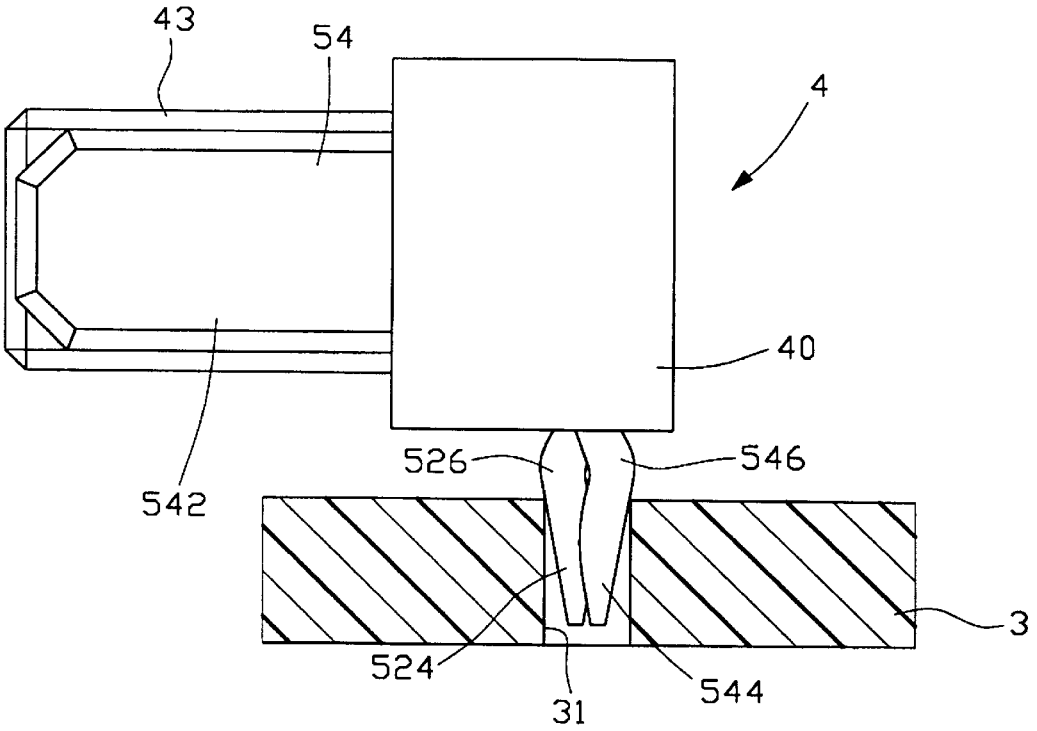
FIG. 7 (PRIOR ART)
FIG. 7 is a cross-sectional view showing the connector of FIG. 6 mounted to a PCB.

Referring to FIGS. 3 to 5, since the outer-most grooves 121 have a depth less than the inner grooves 111, when the contacts 2 are fixedly mounted into the corresponding grooves 121, 111 of the housing 10, the contact portions 22 of the contacts 2 received in the outer-most grooves 121 are located at a position behind the contact portions 22 of the contacts 2 received in the inner grooves 111. In other words, the tail portions 24 of the contacts 2 received in the outer-most grooves 121 are spaced from the front face 102 of the housing 10 a greater distance than that of the tail portions 24 of the contacts 2 received in the inner grooves 111. When the contacts 2 are fixedly mounted in the corresponding grooves 121, 111, the contact portions 22 thereof extend through the corresponding slots 12 to project beyond the front face 102 and the fitting steps 224 interferentially engage with the housing 10.

When the connector 1 is mounted to the printed circuit board 30 by extending the tail portions 24 into corresponding holes 301 defined in the PCB 30, due to a resilience of the tail portions 24, front edges 241 of the tail portions 24 of the contacts 2 received in the outer-most grooves 121 fixedly engage with a front edge of each of the corresponding holes 301, and the engaging portions 242 of the tail portions 24 of the contacts 2 received in the inner grooves 111 fixedly engage with a rear edge of each of the corresponding holes 301. Thus, the connector 1 is fixed to the PCB 30.

In the present invention, the connector 1 only requires one contact type, therefore the manufacturing cost, assembly speed and inventory management thereof is significantly improved.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector comprising:

a housing defining a front face for proximity to an electrical device, a rear face opposite the front face, a bottom face for proximity to a printed circuit board, a top face opposite the bottom face, a number of grooves defined in the rear face and extending from the top face to the bottom face, and a number of slots communicating between the corresponding grooves and the front face of the housing, said grooves having different depths relative to the rear face, wherein the grooves include a pair of outer-most grooves having a depth which is less than that of other grooves; and a number of substantially identical contacts corresponding to the number of the grooves being fixedly mounted in the grooves of the housing, each contact having a contact portion and a tail portion, wherein the contact portions project forwardly beyond the front face of the housing and the tail portions project downwardly beyond the bottom face of the housing and are spaced from the front face of the housing at different distances.

2. The connector in accordance with claim 1, wherein each contact portion includes a fitting step interferentially engaging with the housing.

3. The connector in accordance with claim 1, wherein each contact portion is perpendicular to a corresponding tail portion.

4. The connector in accordance with claim 1, wherein each tail portion is formed with an engaging portion projecting therefrom toward the rear face of the housing.

5. The connector in accordance with claim 1, wherein the housing has a locating wall projecting forward from the front face thereof for ensuring the correct orientation of a mating connector to be connected to the connector.

6. A combination of an electrical connector and a printed circuit board, comprising:

a printed circuit board defining a row of holes each having a first edge and a second edge opposite the first edge; and an electrical connector mounted to the printed circuit board, said electrical connector comprising:

a housing defining a number of grooves with different depths; and a number of substantially identical contacts corresponding to the number of the grooves being fixedly mounted in the grooves of the housing, each contact having a contact portion and a tail portion, said connector being mounted to the printed circuit board by extending the tail portions into the row of holes in the printed circuit board, wherein some tail portions fixedly engage only with first edges of some of the row of holes defined in the printed circuit board and the other tail portions fixedly engage only with second edges of the other holes in the printed circuit board.

7. The combination in accordance with claim 6, wherein the contact portion includes a fitting step interferentially engaged with the housing.

8. The combination in accordance with claim 6, wherein the contact portion is perpendicular to the tail portion.

9. The combination in accordance with claim 6, wherein the tail portion is formed with an engaging portion projecting from the tail portion toward a rear face of the housing.

10. The combination in accordance with claim 6, wherein the housing has a locating wall projecting forward from a front face thereof, said locating wall being used for ensuring the correct orientation of a mating connector to be connected to the connector.

11. A battery connector for connecting a battery to a printed circuit board in an electrical apparatus, comprising:

a substantially rectangular housing having a front face for proximity to a battery, a rear face opposite the front face, a bottom face for proximity to a printed circuit board, a top face opposite the bottom face, two side faces defined between the front, rear, top and bottom faces, respectively, two outer-most grooves and a number of inner grooves between the outer-most grooves being defined in the rear face from the top face to the bottom face, the outer-most grooves having a depth which is different from that of the inner grooves and located closer to the side faces than the inner grooves; and a number of substantially identical contacts corresponding to the number of the grooves being fixedly mounted in the grooves of the housing, and each having a contact portion projecting forwardly from the front face of the housing for electrically connecting with a battery, and a tail portion projecting downwardly from the bottom face of the housing for connecting with a printed circuit board, the tail portions of the contacts in the outer-most grooves being spaced from the front face of the housing a distance different from that of the contacts in the inner grooves.

12. The battery connector in accordance with claim 11, wherein the outer-most grooves have a depth which is less than that of the inner grooves, and the tail portions of the contacts in the outer-most grooves are spaced from the front face of the housing a distance which is greater than that of the tail portions of the contacts in the inner grooves.

13. The battery connector in accordance with claim 11, wherein the contacts have a quantity of six.

14. The battery connector in accordance with claim 11, wherein each contact portion includes a fitting portion interferentially engaging with the housing.

15. The battery connector in accordance with Clam 14, wherein the fitting portion has a step-like shape.

16. The battery connector in accordance with claim 11, wherein each contact has its contact portion perpendicular to its tail portion.

17. The battery connector in accordance with claim 11, wherein each contact has its tail portion formed with an engaging portion projecting form the tail portion toward the rear face of the housing.

18. The battery connector in accordance with claim 11, wherein the housing has a locating wall projecting forward from the front face thereof, said locating wall being used for ensuring the correct orientation of a mating connector to be connected to the connector.

* * * * *

UNITED STATES PATENT AND TRADEMARK OFFICE

CERTIFICATE OF CORRECTION

PATENT NO. : 6,159,042
DATED : December 12, 2000
INVENTOR(S) : Liu et al.

It is certified that error appears in the above-identified patent and that said Letters Patent is hereby corrected as shown below:

Title page,
Item [*] Notice, insert -- Subject to any disclaimer, the term of this patent is extended or adjusted under 35 USC 154(b) by 39 days --

Signed and Sealed this

Nineteenth Day of October, 2004

JON W. DUDAS
*Director of the United States Patent and Trademark Office*